United States Patent [19]

Evrard

[11] 4,452,572

[45] Jun. 5, 1984

[54] DRY VACUUM DIAPHRAGM PUMP

[76] Inventor: Robert Evrard, 5 rue, 95690 Nesles la Vallee, France

[21] Appl. No.: 401,060

[22] Filed: Jul. 23, 1982

[30] Foreign Application Priority Data

Jul. 24, 1981 [FR] France ..... 81 14489

[51] Int. Cl.[3] ..... F04B 43/10

[52] U.S. Cl. ..... 417/395; 417/478

[58] Field of Search ..... 417/245, 382, 394, 395, 417/478, 324, 390, 392, 377, 323

[56] References Cited

U.S. PATENT DOCUMENTS

| | | | |
|---|---|---|---|
| 2,970,546 | 2/1961 | White | 91/39 X |
| 3,824,792 | 7/1974 | Grabb et al. | 417/395 X |
| 4,212,589 | 7/1980 | Bosio | 417/394 X |
| 4,269,906 | 5/1981 | Schmechtig | 417/383 X |

*Primary Examiner*—Leonard E. Smith

*Attorney, Agent, or Firm*—Pollock, Vande Sande & Priddy

[57] ABSTRACT

Dry vacuum diaphragm pump, for pumping between an inlet port (2) and an exhaust port (3), and comprising a tubular diaphragm (12) retained by its resilience on a central body (11) in the biconical interior volume of a body (1), in such manner as to form a pumping chamber (15) into which debouch inlet and exhaust ports, and a control chamber (16).

Port (3) communicates through a valve (7) with a capacity (9) maintained under partial vacuum by an auxiliary vacuum pump (23).

The distribution mechanism (20, 21, 27) places the chamber (16) in communication alternatively with atmosphere and with the intake of the auxiliary pump (23).

9 Claims, 6 Drawing Figures

58
27
55
54
12
50
60
7
3
1
17
20
2
11
52
16

58
57
27
55
54
53
51
16
50
12
9
60
7
3
1
51
26
13
17
20
5
2
11
52
15
16

DRY VACUUM DIAPHRAGM PUMP

The present invention relates to a dry vacuum diaphragm pump, more particularly intended to constitute at least one stage of a vacuum pump for the obtention of a vacuum free of oil contamination.

For many applications of vacuum technology, the obtainment of a "clean" vacuum, without oil contamination, is an essential need. This is why oil diffusion pumps are more and more frequently replaced by ionic pumps, cryogenic pumps, etc. Unfortunately these modern pumps can be placed in operation only if a "primary" vacuum, of the order of 1 Pascal or less, has already been obtained. Of course, this primary vacuum must also be clean. According to the existing state of the art, this result can only be achieved by means of sorption pumps, cooled by liquid nitrogen, with all the disadvantages this involves.

The only "clean" mechanical pumps now in use are diaphragm pumps. In one-stage systems, their vacuum limit is of the order of some $10^4$ Pascals at least. This relatively high limit is due, among other things, to the use of valves. Particularly, the conductance of an inlet valve decreases with the pressure of the vacuum system, and tends toward zero. Moreover, the valves generate what is called "dead volume"; at the end of each cycle, a small volume of pumped gas is trapped at the exhaust pressure and returns to the evacuated chamber. Finally, movement of the diaphragm is obtained by rigid coupling with a mechanical device. The flexibility of the diaphragm is thus considerably lessened, augmenting the dead volume still further. But, above all, the exhaust conductance for the parts which are at a distance from the exhaust valve becomes very weak. A certain quantity of gas is thus trapped at high pressure, deforming the diaphragm and considerably increasing the dead volume.

The object of the present invention is a means for obtaining, with a diaphragm pump, a "clean" primary vacuum, corresponding to a pressure limit much lower than those obtained with existing devices.

The invention therefore relates to dry vacuum diaphragm pump for transferring a gas from at least one inlet port to at least one exhaust port, constituted by a resilient diaphragm retained between a first and a second rigid body, in such manner that the volume between the diaphragm and the first rigid body constitutes a pumping chamber into which the inlet ports and the exhaust ports flow, and that the volume on the other side of the diaphragm constitutes a control chamber for actuating the diaphragm to cause it to vary the pressure cyclically so as to generate alternatively:

(a) an exhaust movement in which the diaphragm is forced progressively against the first rigid body, thereby first blocking the inlet ports and then exhausting the gas in the direction of the exhaust ports;

(b) an intake movement in which the diaphragm is returned toward the second rigid body, causing first the closure of the exhaust valves and then clearing the inlet ports.

According to the invention, the exhaust ports communicate via the valves with a capacity maintained at lower pressure than atmospheric pressure by an auxiliary vacuum pump. Moreover, it comprises a distribution mechanism to place the control chamber into alternative communication with atmosphere and with the intake of an auxiliary suction pump.

According to a particular embodiment of the invention, (a) the internal surface of the first rigid body has the shape of two truncated cones joined at their bases, the exhaust ports being located in the larger diameter central zone, and the inlet ports in the smaller diameter end zones;

(b) the second body is coaxial with the first;

(c) the resilient diaphragm is of tubular shape, with a natural diameter less than the outer diameter of the second body, and is tightly attached by its ends to the ends of the first body.

According to a variant embodiment, the same auxiliary vacuum pump is used both to maintain a partial vacuum downstream of the exhaust valve, and to create a partial vacuum which is cyclically applied to the control chamber.

According to another variant embodiment, the auxiliary vacuum pump for creating a partial vacuum in the control chamber is constituted by a second tight resilient diaphragm surrounding the second body, between the second body and the first diaphragm; on the other hand, the pump comprises a distribution mechanism for putting the space between the second body and the second diaphragm into alternative contact with atmosphere and with a supply of compressed air, with means for causing the compressed air supply phase to coincide with the phase in which the control chamber is placed into contact with atmosphere, and vice versa.

The invention will be better understood upon referring to the particular embodiments given by way of example and illustrated by the accompanying drawings.

FIGS. 1 and 2 show, in simplified manner, and longitudinal section, a pump according to the invention, provided with an outside auxiliary vacuum pump. FIG. 1 shows the pump at the end of the intake phase; FIG. 2 at the end of the exhaust phase.

Figure 2:
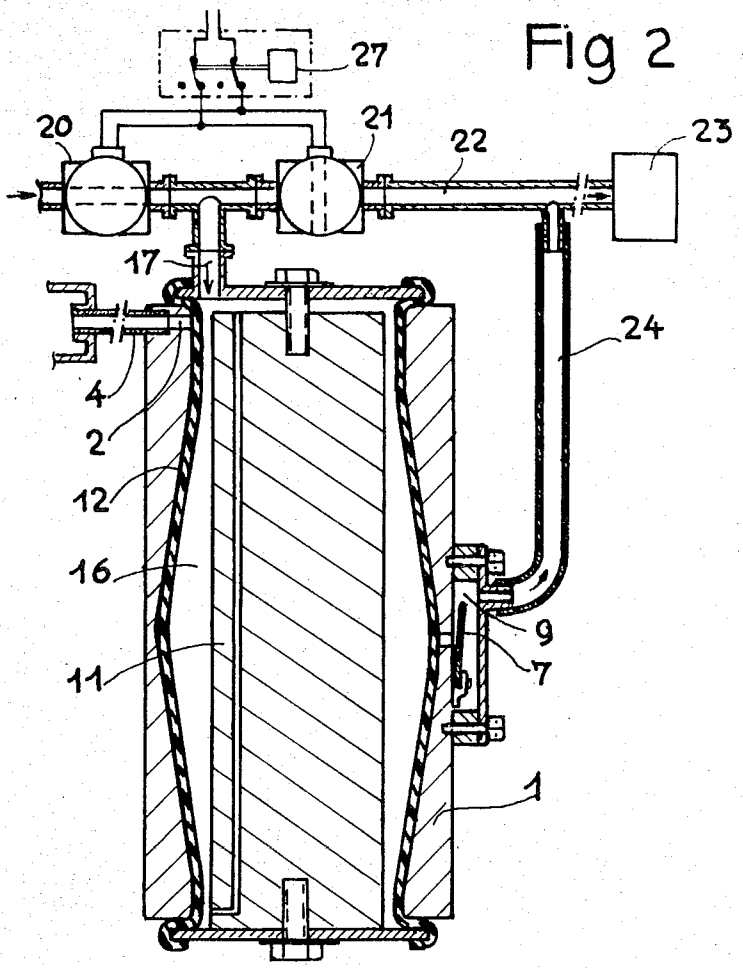
Figure 1:
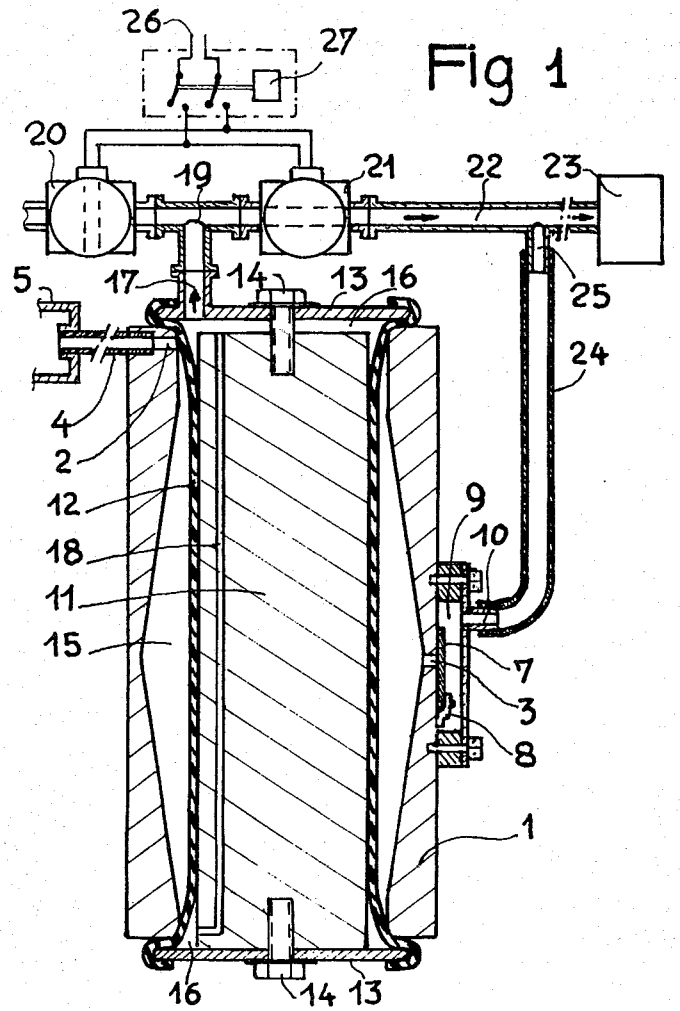

Referring first to FIGS. 1 and 2, it will be seen that the pump is constituted by a first rigid hollow body 1, the inner wall of which is in the shape of two truncated cones connected by their bases. Body 1 comprises an inlet port 2 in an end zone of small inner diameter, while the exhaust port 3 is located in the central portion, which has a larger inner diameter. Inlet port 2 is connected by a pipe 4 to an enclosure 5 in which the vacuum is to be created. Exhaust port 3 is provided with a valve 7 constituted by a simple resilient leaf one end of which is attached at 8 to body 1, while its other end is free to engage against the body or to separate therefrom, according to the pressure vaviations on both sides of the body. Valve 7 is at the interior of a small exhaust chamber 9 provided with a nozzle 10.

The center of hollow body 1 is occupied by a cylindrical body 11 covered by a tight, tubular resilient diaphragm 12, e.g., a product sold under the trademark "NEOPRENE." The natural inner diameter of diaphragm 12 is smaller than the outer diameter of body 11, so that it is applied under stress against body 11.

Diaphragm 12 is distended at each end in order to enclose an end plate 13; each end plate 13, by tightening of screws 14 engaged with body 11, tightly blocks each end of diaphragm 12 on the end faces of body 1. Two inner chambers are thus obtained. Chamber 15, between diaphragm 12 and body 1, constitutes the pumping chamber proper, into which flow both inlet ports 2 and exhaust ports 3. Chamber 16, between diaphragm 12 and body 11, constitutes the control chamber under the effect of a distribution system to which it is connected by conduit 17. While, as in FIG. 1, diaphragm 12 is in position against body 11, chamber 16 is in fact separated into two parts, each at one end of body 11, but connected by balancing conduit 18.

Conduit 17, through T-conduit 19, is connected to two two-path electromagnetic sluice gates 20 and 21. The other path of sluice gate 20 communicates directly with atmosphere. The other path of sluice gate 21 is connected by conduit 22 to an auxiliary vacuum pump 23. A pipe 24 connects nozzle 10 of exhaust chamber 9 to a tap 25 on conduit 22, in the vicinity of sluice gate 21.

The type and branching of the electric supply of electromagnetic sluice gates 20 and 21 are such that they operate in opposition, i.e., that one of them is necessarily open while the other is closed, and vice versa. In the example shown in FIGS. 1 and 2, sluice gate 20 is normally closed and sluice gate 21 is normally open, and the two spools are supplied in parallel from a line 26, by means of an oscillating relay 27 which cyclically places under tension and cuts off the supply of the two spools.

The first phase of creating a vacuum in enclosure 5 may be assured by the conventional auxiliary pump 23. Sluice gates 20 and 21 are without tension, with oscillating relay 27 in rest position, as shown in FIG. 1. Pump 23 thus exhausts enclosure 5 directly, via pipe 4, port 2, chamber 15, port 3, open valve 7 and pipe 24; at the same time, it maintains chamber 16 under partial vacuum, enabling diaphragm 12 to remain against body 11 through its own resilience.

When the vacuum has reached the practical limit of 1 to $2.10^4$ Pascals, the pump according to the invention is placed in operation in activating relay 27. When the relay swings into the position shown in FIG. 2, the spools of sluice gates 20 and 21 are supplied; 21 is closed and 20 open. Atmospheric pressure is established in chamber 16, and diaphragm 12 is inflated from inside so as to move against the biconical inner face of body 1. During the movement, the diaphragm first closes inlet port 2; then the progressive reduction in the volume of chamber 16 forces, while compressing it, the gas which it contains toward exhaust port 3. The conjugate action of compression upstream of valve 7 and of the partial vacuum permanently created downstream by auxiliary pump 23 is sufficient to raise the valve and to force the gas toward pipe 24.

When relays 27 resume the position of FIG. 1, chamber 16 is again placed in partial vacuum, and the resilience of the diaphragm brings the same back into contact with central body 11. This movement brings about first the closing of exhaust valve 7, then a very strong partial vacuum in pumping chamber 15, because the intake conduit remains blocked by the diaphragm until the last part of the return movement of the latter. When port 2 is uncovered, a part of the gas remaining in enclosure 5 is sucked into chamber 15, and a new exhaust phase can begin by a fresh inversion of the position of relay 27 and sluice gates 20 and 21.

It will be noted that, in the system which has been described, valve 7, although constituted by a simple resilient leaf, in fact functions like a complex pneumatic control valve: at the start of the intake phase, sluice gate 21 opens and air return sluice gate 20 closes. The air accumulated in chamber 16 under diaphragm 12 expands in auxiliary circuit 22, 24, and the pressure downstream of exhaust valve 7 rises abruptly. This valve is thus pressed energetically onto its seat, and "return flux" is practically eliminated during the critical intake phase. The downstream pressure, continually pumped by auxiliary pump 23, will then decrease continually. At the start of the compression phase, the air return gate 20 opens as gate 21 closes, so as to isolate the auxiliary pumping circuit downstream of the valve. The pressure in exhaust chamber 9 therefore continues to decrease during the compression in chamber 15, and the gas can easily be evacuated through valve 7 which has become slack due to a minimal adherance force. This optimization of the operation of the exhaust valve eliminates the disadvantages of the "stiff" exhaust valves, such as existed in conventional devices.

In order to facilitate the action of the return flux so as to flatten valve 7 energetically against its seat at the start of the intake phase, it is desirable to create a strong conductance between chamber 9 downstream of valve 7 and inlet port 17 of control chamber 16. This will be accomplished if tap 25 on conduit 22 is close to sluice gate 21.

In order to improve the operation still further, diaphragm 12 can have a smaller diameter at its ends. The blocking of inlet port 2 then occurs at a moment more in advance of the compression phase.

The selection of this geometry is dictated by the following considerations: tubular diaphragm 12 with a smaller diameter than the exterior diameter of cylinder 11 is here always held. It thus retracts for a reasonable partial vacuum between it and cylinder 11, even if the vacuum between it and body 1 is already very developed. Besides, the symmetrical shape of 1, with the exhaust port in the center, assures that, at the end of compression, the residual exhaust cavity is located precisely opposite corresponding port 3. The "dead volume" is thus reduced to a minimum.

The rate of multiplication of pressure in chamber 15, between the intake position of FIG. 1 and the exhaust position of FIG. 2, is at least of the order of 500. The new pump can thus play the role of a "supercharging pump." Its coupling with the existing coarse dry vacuum pumps transforms the latter into high performance pumps and divides the vacuum limit by a factor of at least 500.

The pumping speed depends essentially on the frequency of the intake cycle, i.e., on the pumping speed of the auxiliary pump. The partial vacuum required for the operation is of the order of $2.10^4$ Pascals or more, and corresponds to a range of pressure where the pumping speed of conventional diaphragm pumps is great.

The "supercharging pump" not only improves the pressure limit considerably, but also permits utilization of a conventional pump under pressure conditions which are optimal for the pumping speed.

Figure 3:
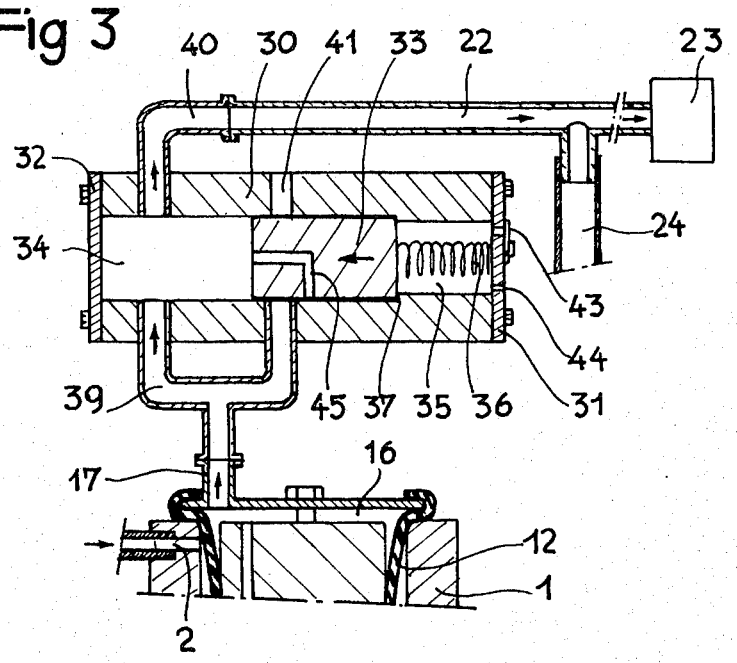
FIGS. 3 and 4 show a modification of the distribution mechanism, applied to the pump of FIGS. 1 and 2, respectively in control positions of intake and of exhaust.
Figure 4:
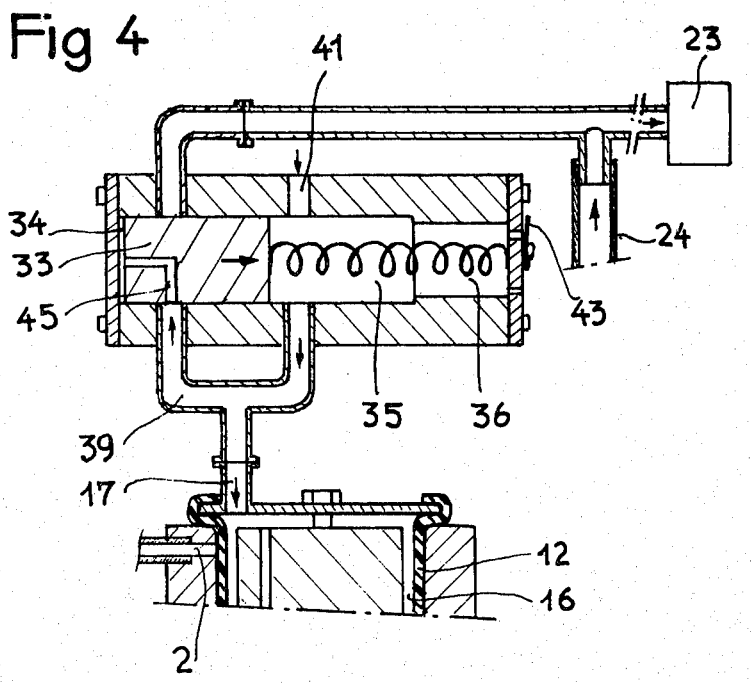

It is clear that the sluice gates controlled by oscillating relays constitute only one embodiment among others of distribution devices to establish communication of control chamber 16 with atmosphere and with auxiliary pump 23. FIGS. 3 and 4 show, in simplified form, another device functioning in purely pneumatic form and producing the same functions as the association of two sluice gates 20 and 21. The device, which constitutes a partial vacuum dynamometer with piston and return spring, comprises a tubular body 30 in bronze, closed by two plates 31 and 32. A piston 33 slides freely in the bore of body 30, which it separates tightly into two chambers 34 and 35. Piston 33 is drawn back by a draw spring 36 up to a position in abutment with a shoulder 37. Conduit 17 of chamber 16 is connected by a U-shaped conduit 39 with an inner chamber 34 of body 30. Within chamber 34, and opposite to a branch of conduit 39, a conduit 40 linked to conduit 22 connecting with auxiliary pump 23 also opens. A port 41 also opens opposite to the other branch of conduit 39 to place chamber 34 into communication with the exterior. Plate 31 comprises an escape valve 43 and a calibrated port 44 between chamber 345 and the exterior. Finally, the internal elbow conduit 45 opens on the lateral face of piston 33, a conventional guide (not shown) being provided to prevent the latter from turning during its longitudinal course, in such manner that the lateral opening of conduit 45 passes in front of the branches of conduit 39.

In the position shown in FIG. 3, the device is equivalent to two electromagnetic sluice gates 20 and 21 in their FIG. 1 positions. In effect, chamber 16 communicates with the auxiliary pump by 17, 39, 34, 40 and 22, while the communication with atmosphere is cut by piston 33 which seals port 41. The partial vacuum produced in chamber 34 draws along piston 33 toward the left, against the suction of draw spring 36. But this movement is slowed down by calibrated port 44 which permits air to penetrate only very progressively into chamber 35.

When the piston approaches the end of its path, it blocks both conduit 40 and the left branch of conduit 39, terminating inflow into chamber 16, equivalent to the closing of sluice gate 21 in the electric solution. Under the effect of the temporization, the piston slowly pursues its course toward the left, although the rest of chamber 34, still under partial vacuum, is isolated. The piston then uncovers port 41 and the right-hand branch of conduit 39, thereby abruptly placing chamber 16 in communication with atmosphere via 17, 39, 35 and 41, equivalent to the opening of sluice gate 20. Under the effect, this time more abrupt, of atmospheric pressure in chamber 35, piston 33 ends its travel toward the left until the moment when conduit 45 arrives before the left-hand branch of 39 (FIG. 4). The atmospheric pressure is then established on the two faces of piston 33, which is recalled rapidly toward the right by spring 36, without pneumatic braking because the air in chamber 35 freely escapes through valve 43.

During this movement, the recoil of the piston cuts off communication with atmosphere of chamber 16, and reestablishes there the partial vacuum of pump 23, corresponding to a new intake cycle.

Figure 6:
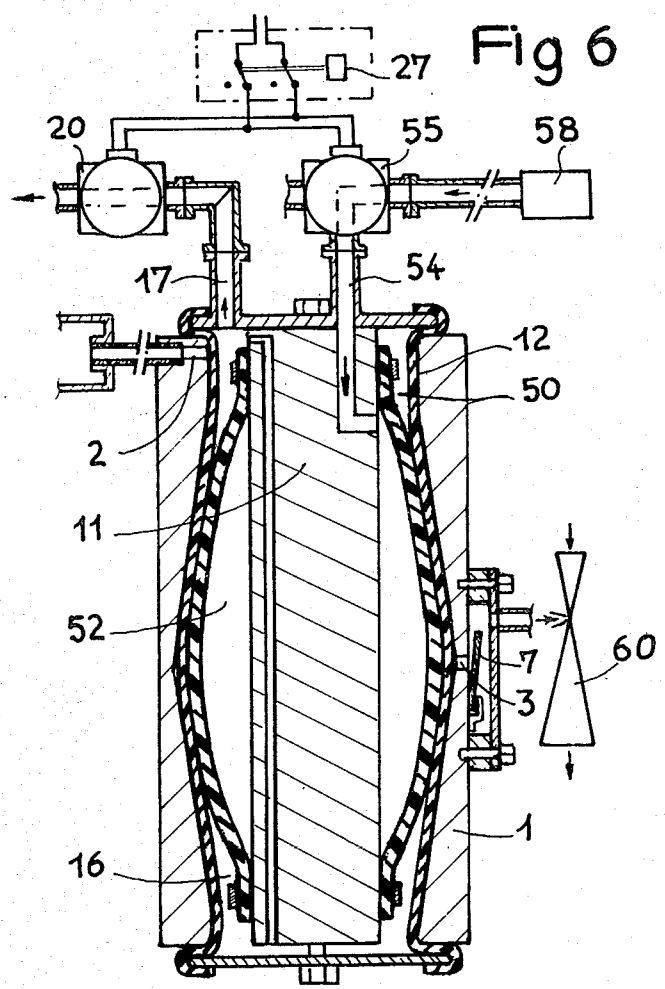
FIGS. 5 and 6 show, in the same conditions as FIGS. 1 and 2, respectively at the end of intake and at the end of exhaust, a modification of the integrated auxiliary control pump.
Figure 5:
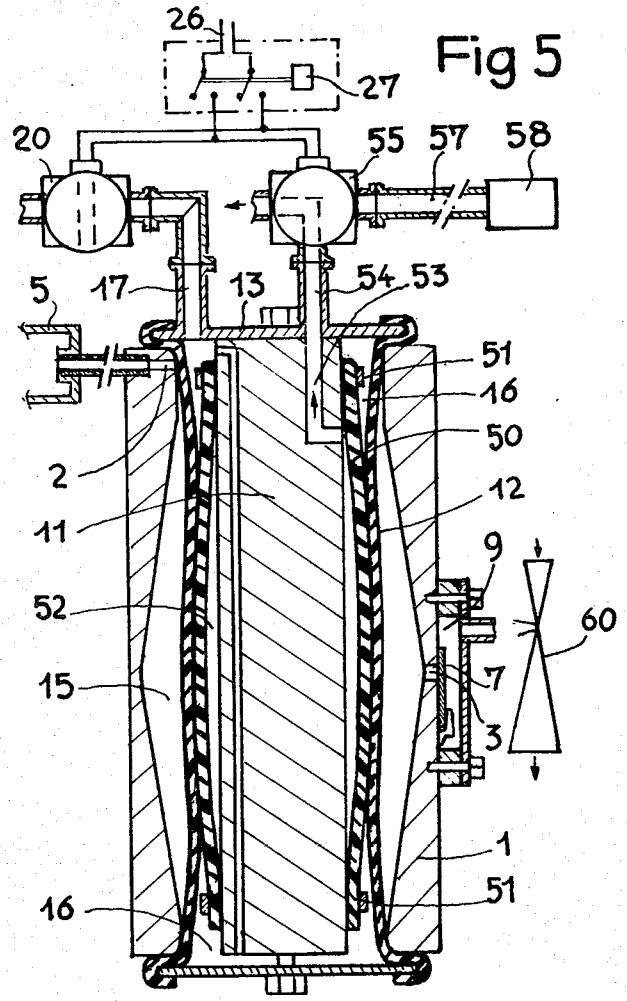

Attention is now directed to FIGS. 5 and 6, for a modification of an auxiliary pump with integrated control. Here the geometry is generally the same, but the central cylindrical body 11 is surrounded by another thick, tight, resilient diaphragm 50, of tubular shape and drawn hermetically by its ends onto body 11 by means of clamps 51.

One thus obtains, between the biconical inner surface of body 1 and central body 11, in succession:

(1) pumping chamber 15 itself, into which open, as in the first embodiment, inlet ports 2 and exhaust ports 3;

(2) control chamber 16 which communicates through conduit 17 only with a single sluice gate 20, which is normally closed, and the other outlet of which is to atmosphere;

(3) an internal chamber 52 which constitutes the control chamber of the integrated auxiliary pump. Chamber 52 communicates, through conduit 53 interior to body 11, then through conduit 54 which extends it in passing through plate 13, with the central circuit of a distributor here constituted, for example, by a three-path electromagnetic sluice gate 55.

At rest, when the spool of the sluice gate is not supplied, as shown in FIG. 5, conduit 54 communicates with atmosphere. When the spool is under tension, the sluice gate places conduit 54 in communication with conduit 57 connected to a compressed air distribution 58, autonomous compressor or distribution network.

The branching of electric supply of sluice gates 20 and 55 is such that when sluice gate 20 is closed, sluice gate 55 opens conduit 54 to atmosphere, and when sluice gate 20 is open, sluice gate 55 supplies conduit 54 and chamber 52 with compressed air. The spools of sluice gates 20 and 55 are supplied in parallel from line 26, by means of an oscillating relay 27 which cyclically places the two spools under tension and then cuts the supply.

As in the embodiment of FIGS. 1 and 2, the exhaust chamber 9 downstream of valve 7 is kept under permanent partial vacuum; this is best accomplished by connecting its nozzle 10 to a compressed air ejector 60.

In the position shown in FIG. 6, corresponding to the end of the exhaust phase, the atmospheric pressure produced by the opening of sluice gate 20 in chamber 16 forces back diaphragm 12 onto the interior face of body 1. At the same time, the compressed air led into chamber 52 by sluice gate 55 expands diaphragm 50, which moves into contact with diaphragm 12 and reduces the volume of chamber 16 to a minimum. The swinging of relay 27 then cuts the supply of the spools of the two electromagnetic sluice gates 20 and 55, which take the positions shown in FIG. 5. The opening to atmosphere of chamber 52 permits diaphragm 50 to resume its normal position so as to adhere to body 11. By its retreat, diaphragm 50 creates a strong partial vacuum in chamber 16 under diaphragm 12, because sluice gate 20 prevents air from entering thereinto. The partial vacuum in chamber 16 in turn permits diaphragm 12 to retract toward diaphragm 50 and body 11, thereby producing a strong partial vacuum in pumping chamber 15, and intake from the time that port 2 is uncovered.

It will be seen that internal diaphragm 50 and its actuation of expansion with compressed air or contraction play the same part as auxiliary pump 23 of the first embodiment in creating a partial vacuum under main diaphragm 12 during the intake phase. But here the maintenance of the partial vacuum in exhaust chamber 9 is assured by independent ejector 60.

In this compressed air version, the pumping speed depends essentially on the flow from the supply circuit which is used. The intake volume is much greater than in the diaphragm pumps with mechanical coupling, and the pumping speed can be greatly increased.

These new pumps are therefore quite naturally intended for applications where a proper primary vacuum much smaller than $10^2$ Pascal is to be obtained by practical and simple means, e.g., for the priming of ionic, cryogenic or turbomolecular pumps, mainly used in research laboratories and in the electronic industry.

I claim:

1. Dry vacuum diaphragm pump for transferring a gas from at least one inlet port (2) to at least one exhaust port (3), constituted by a resilient diaphragm (12) retained between a first and second rigid body, in such manner that the volume between the diaphragm (12) and the first rigid body (1) constitutes a pumping chamber (15) into which open the inlet ports and the exhaust ports, and that the volume on the other side of the diaphragm (12) constitutes a control chamber (16) for actuating the diaphragm to cause it to vary the pressure cyclically so as to generate alternatively:

(a) an exhaust movement in which the diaphragm (12) is forced progressively against the first rigid body (1), thereby first blocking the inlet ports, and then exhausting the gas in the direction of the exhaust ports, (b) an intake movement in which the diaphragm (12) is returned toward the second rigid body (11), causing first the closure of the exhaust valves and then clearing the inlet ports, wherein the exhaust ports (3) communicate via the valves (7) with a capacity (9) maintained at a pressure lower than atmospheric pressure by an auxiliary vacuum pump (23), and by the fact that the same comprises a distribution mechanism (21, 22) for placing the control chamber (16) alternatively in communication with atmosphere and with the intake of an auxiliary vacuum pump.

2. Pump according to claim 1, wherein said distribution mechanism is constituted by two two-path electromagnetic sluice gates (20, 21) connected in parallel by one of their paths to the conduit (17) for actuating the control chamber, and by their other path respectively to atmosphere and to the intake of the auxiliary pump (23), the two sluice gates being controlled in opposition by means of an oscillating relay (27).

3. Pump according to claim 1 wherein said distribution mechanism is constituted by a partial vacuum dynamometer (30), with piston (33) and return spring (36).

4. Pump according to claim 1 wherein said first diaphragm (12) has a reduced diameter in the area of the inlet ports (2).

5. Pump according to claim 1, wherein (a) the internal surface of the first rigid body (1) has the shape of two truncated cones joined at their bases, the exhaust ports (3) being located in the larger diameter central zone, and the inlet ports (2) in the smaller diameter end zones;

(b) the second body (11) is coaxial with the first;

(c) the resilient diaphragm (12) is of tubular shape, with a natural diameter less than the outer diameter of the second body (11), and is tightly attached by its ends to the ends of the first body (1).

6. Pump according to claim 5, wherein said auxiliary vacuum pump for creating a partial vacuum in the control chamber (16) is constituted by a second tight resilient diaphragm (50) surrounding the second body between the second body (11) and the first diaphragm (12), and by the fact that the pump comprises a distribution mechanism (20, 55) for placing the space (52) between the second body (11) and the second diaphragm (50) in alternative communication with atmosphere and with a compressed air distribution (58), with means to cause the compressed air supply phase to coincide with the phase in which the control chamber (16) is placed in communication with atmosphere, and vice versa.

7. Pump according to claim 6, wherein said distribution mechanism relative to the space between the second body and the second diaphragm is an electrically controlled distributor (55) controlled by the same oscillating relay (27) which also controls the placement of the control chamber (16) in communication with atmosphere.

8. Pump according to claim 1 or 5, wherein the same auxiliary vacuum pump (23) is used for creating a partial vacuum downstream of the exhaust valve (7) and for creating the cyclically applied partial vacuum in the control chamber (16).

9. Pump according to claim 8, wherein the intake conduit of the auxiliary vacuum pump (23) comprises a strong conductance branch (22, 24) between the downstream side of the exhaust valve (7) and the intake conduit (17) in the control chamber (16).

* * * * *